US006183300B1

(12) United States Patent
Belopolsky et al.

(10) Patent No.: US 6,183,300 B1
(45) Date of Patent: Feb. 6, 2001

(54) FILTERED UNIVERSAL SERIAL BUS

(75) Inventors: Yakov Belopolsky, Harrisburg; Robert E. MacMullin, Wellsville, both of PA (US)

(73) Assignee: Berg Technology, Inc., Reno, NV (US)

( * ) Notice: Under 35 U.S.C. 154(b), the term of this patent shall be extended for 0 days.

(21) Appl. No.: 09/440,948

(22) Filed: Nov. 16, 1999

Related U.S. Application Data

(63) Continuation of application No. 08/846,700, filed on Apr. 30, 1997, now Pat. No. 5,984,725.

(51) Int. Cl.[7] ..... H01R 13/648
(52) U.S. Cl. ..... 439/607; 439/620
(58) Field of Search ..... 439/607, 608, 439/609, 610, 620

(56) References Cited

U.S. PATENT DOCUMENTS

| | | | | |
|---|---|---|---|---|
| 4,959,626 | | 9/1990 | Mouissie | 333/182 |
| 5,073,130 | | 12/1991 | Nakamura | 439/607 |
| 5,151,054 | | 9/1992 | Briones et al. | 439/620 |
| 5,224,878 | * | 7/1993 | Lurie et al. | 439/620 |
| 5,257,950 | * | 11/1993 | Lenker et al. | 439/620 |
| 5,286,221 | * | 2/1994 | Fencl et al. | 439/607 |
| 5,331,505 | * | 7/1994 | Wilheim | 439/607 |
| 5,344,342 | | 9/1994 | Briones | 439/620 |
| 5,397,250 | | 3/1995 | Briones | 439/620 |
| 5,407,366 | | 4/1995 | Briones et al. | 439/639 |
| 5,587,884 | | 12/1996 | Raman | 361/728 |
| 5,624,277 | | 4/1997 | Ward | 439/620 |
| 5,655,932 | * | 8/1997 | Breitschaft et al. | 439/607 |
| 5,755,595 | * | 5/1998 | Davis et al. | 439/607 |
| 5,766,043 | * | 6/1998 | Talend | 439/607 |
| 5,984,725 | | 11/1999 | Belopolsky et al. | 439/607 |

FOREIGN PATENT DOCUMENTS

| | | |
|---|---|---|
| 0 439 147 A1 | 7/1991 | (EP) . |
| 0 467 400 A1 | 1/1992 | (EP) . |

* cited by examiner

*Primary Examiner*—Hien Vu
(74) *Attorney, Agent, or Firm*—Brian J. Hamilla; M. Richard Page

(57) ABSTRACT

A receptacle adapted to be mounted on a printed wiring board (PWB). The receptacle includes an insulative member comprising a first section extending from a base to an upper side and a second section extending perpendicularly from said vertical section to a terminal edge and said second section having a plurality of longitudinal slots. A plurality of conductive contact means extends first parallel to the second section of the insulative contact in the longitudinal slots and then parallel to the first section of the insulative member. A conductive shield has a first side superimposed in spaced relation over the second section of the insulative member and a second side positioned in spaced relation beneath the second section of the insulative member. A rear side of the shield extend downwardly from the first side. Opposed spaced lateral sides connect the first and second sides of the shield to form a plug receiving cavity between the first side and the second side of the insulative member. A capacitor is positioned between the insulative member and the rear side of the shield.

19 Claims, 9 Drawing Sheets

FILTERED UNIVERSAL SERIAL BUS

This application is a continuation of application Ser. No. 08/846,700, filed Apr. 30, 1997 now U.S. Pat. No. 5,984, 725.

BACKGROUND OF THE INVENTION

1. Field of the Invention

The present invention relates to electrical connectors and more particularly to receptacles which are adapted to be mounted on a printed wiring board (PWB).

2. Brief Description of Prior Developments

Receptacles which are adapted to be mounted on a PWB are well known in the art. The universal serial bus (USB) receptacle, for example, has been proposed for universal use in many computer and computer peripheral applications. In the USB there is essentially an insulative member which houses a plurality of contacts which extend horizontally then vertically to engage the PWB. A conductive shield has an upper wall which is superimposed over the horizontal section of the insulated insert. The conductive shield also has a lower wall adjacent the PWB, and the upper and lower walls are connected with the vertical side walls to form a plug receiving cavity. One disadvantage of such receptacles is that they may provide no filtering means. There is, therefore, a need for a receptacle having an integral filtering means which is adapted to be mounted on a PWB.

SUMMARY OF THE INVENTION

The present invention is a receptacle adapted to be mounted on a printed wiring board (PWB). This receptacle includes an insulative member comprising a first section extending from a base to an upper side and a second section extending perpendicularly from said vertical section to a terminal edge and said second section having a plurality of longitudinal slots. There are also a plurality of conductive contact means extending first parallel to the second section of the insulative contact in the longitudinal slots and then parallel to the first section of the insulative member. A conductive shield has a first side which is superimposed in spaced relation over the second section of the insulative member and a second side positioned in spaced relation beneath the second section of the insulative member. A rear side of the shield extends downwardly from the first side. Opposed spaced lateral sides connect the first and second sides to form a plug receiving cavity between the second side and the second section of the insulative member. A filter is interposed between the first section of the insulating means and the rear side of the filter. Preferably the filter is a capacitor comprised of a dielectric interposed between a ground plane electrode and a signal electrode.

BRIEF DESCRIPTION OF THE DRAWINGS

The invention is further described in the accompanying drawings in which.

DETAILED DESCRIPTION OF THE PREFERRED EMBODIMENTS

Figure 2:
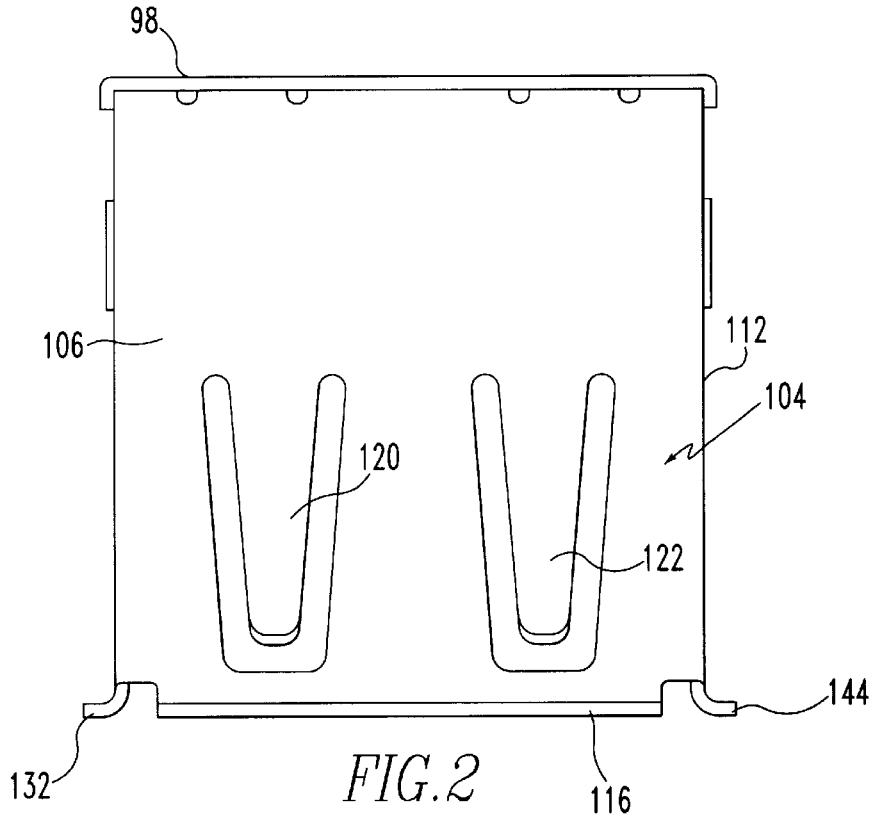
FIG. 2 is a top plan view of the receptacle shown in FIG. 1.
Figure 1:
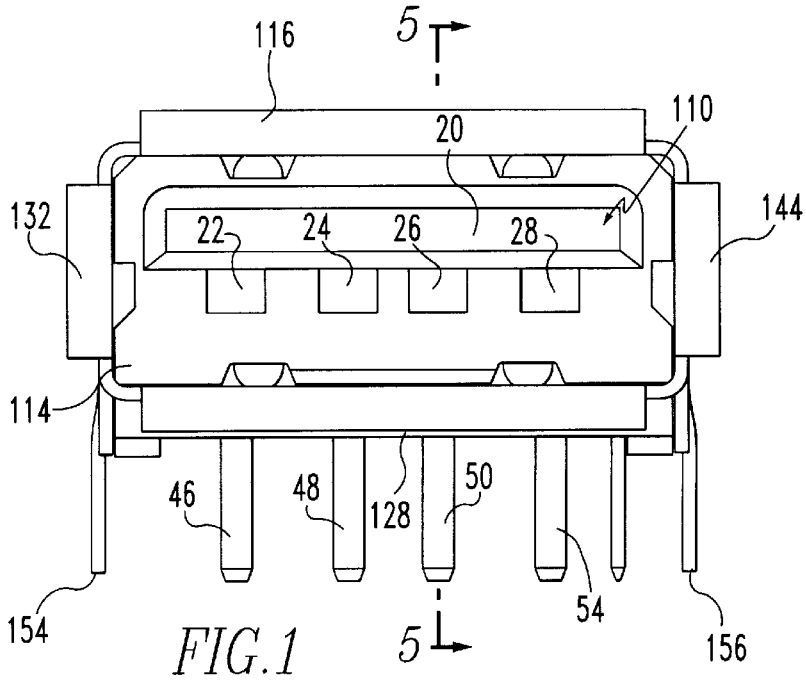
FIG. 1 is a front elevational view of a preferred embodiment of the receptacle of the present invention.
Figure 3:
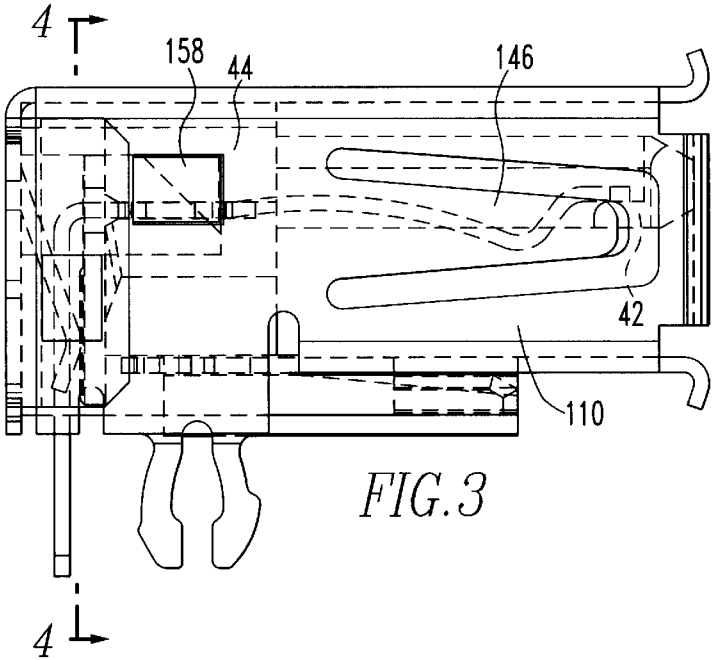
FIG. 3 is a side elevational view of the receptacle shown in FIG. 1.
Figure 4:
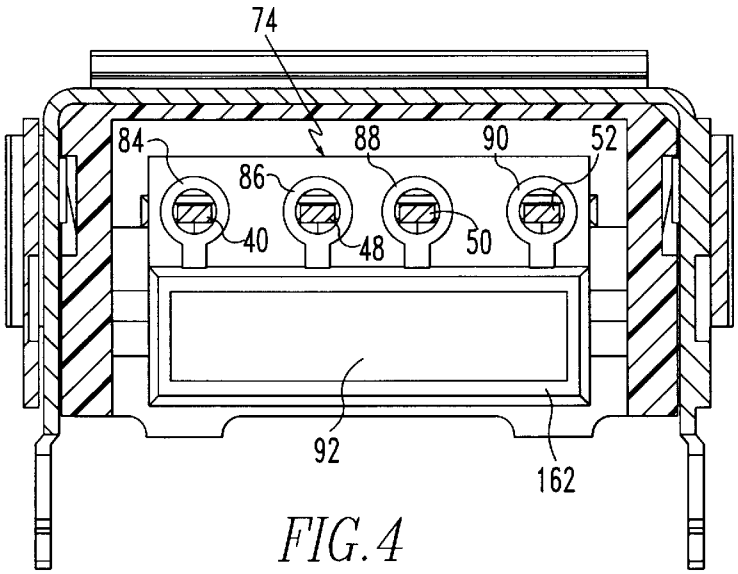
FIG. 4 is a cross sectional view through 4—4 in FIG. 3.
Figure 5:
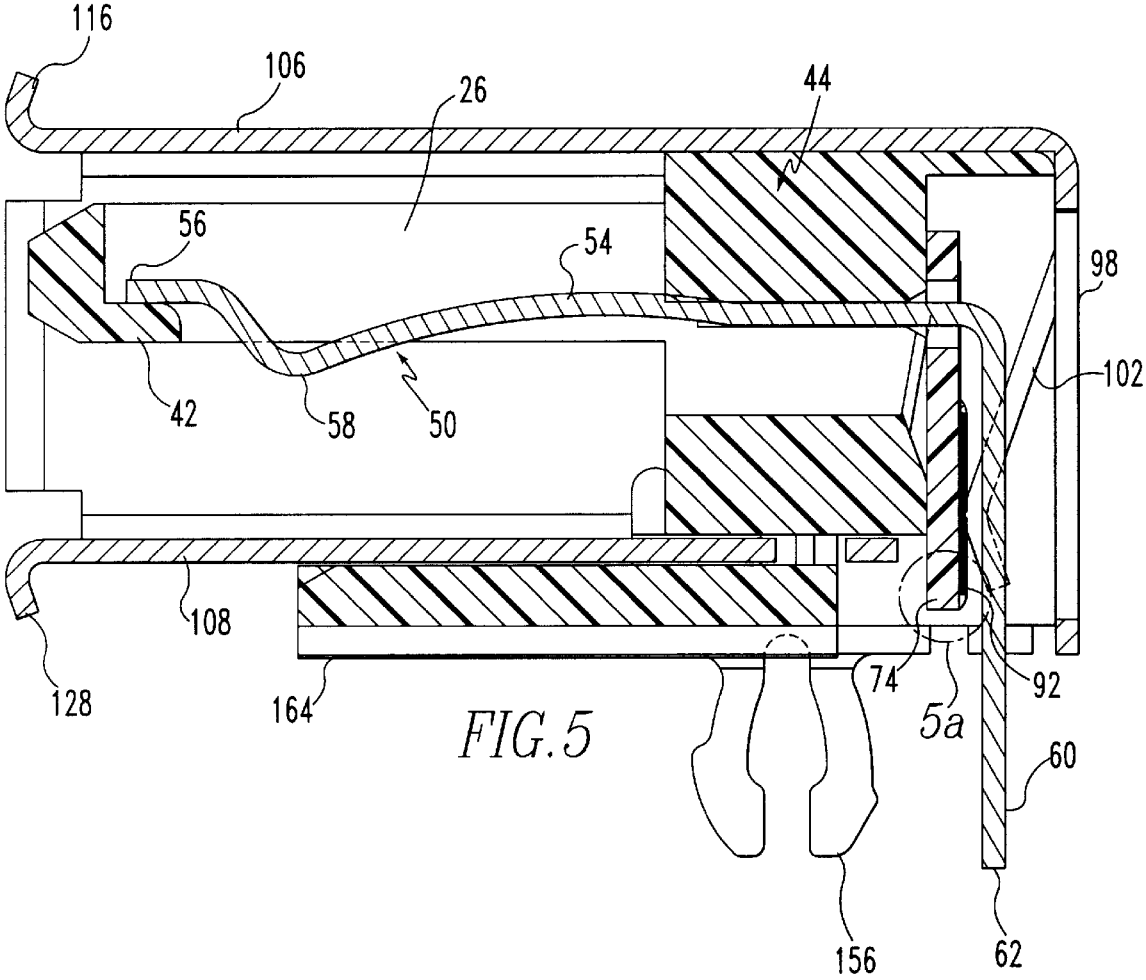
FIG. 5 is a cross sectional view through 5—5 in FIG. 1.
Figure 5A:
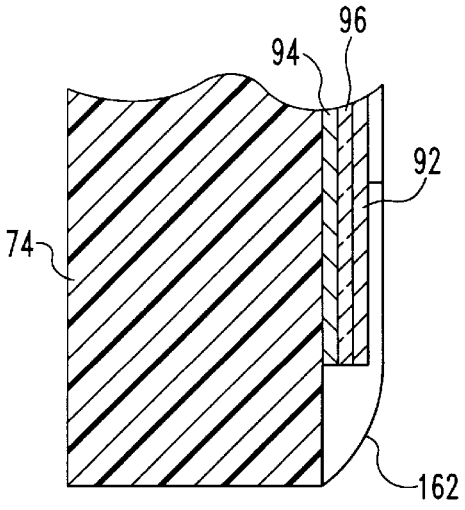
FIG. 5*a* is a detailed view of circle 5*a* in FIG. 5.
Figure 6:
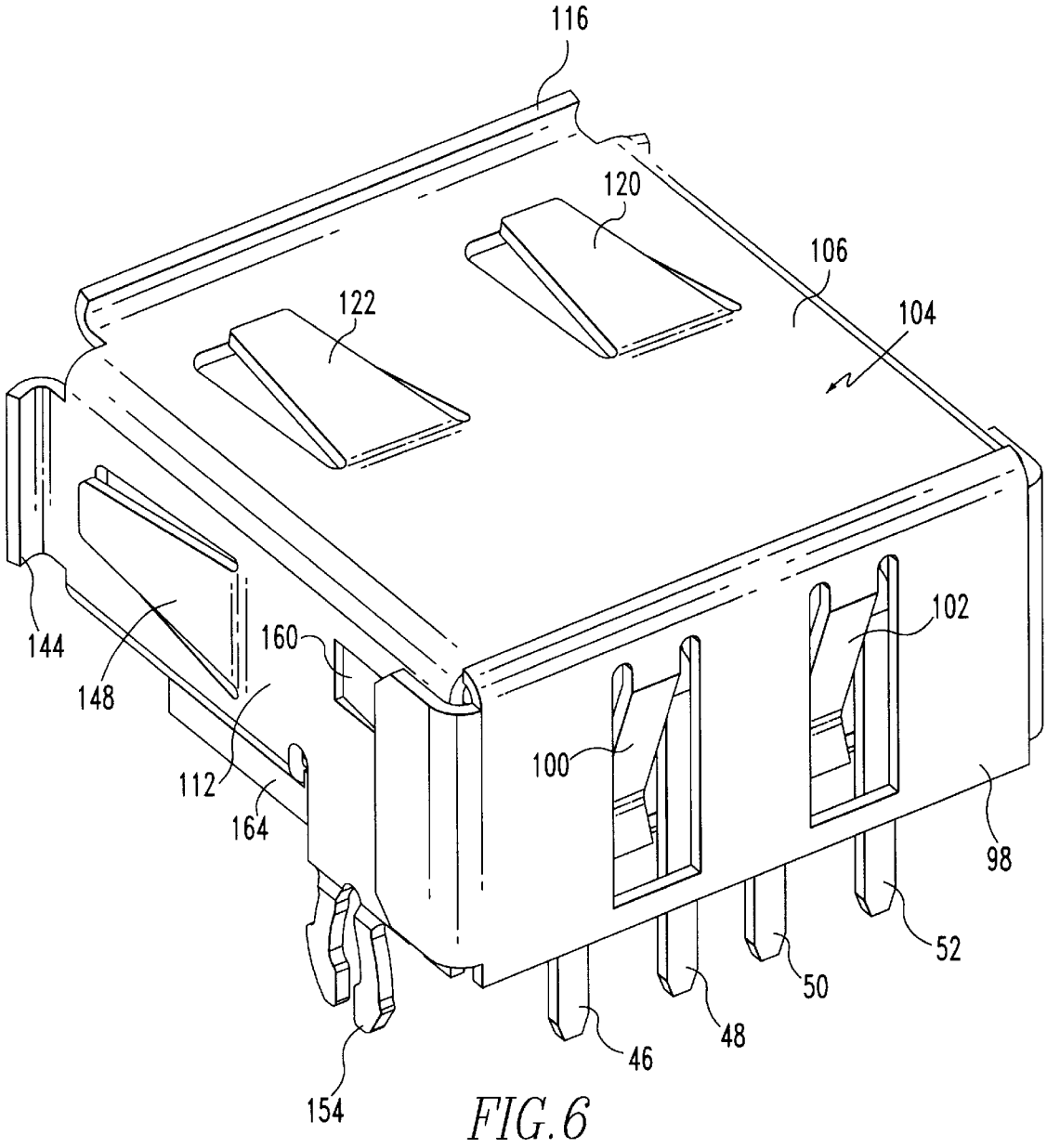
FIG. 6 is a rear perspective view of the receptacle shown in FIG. 1.
Figure 7:
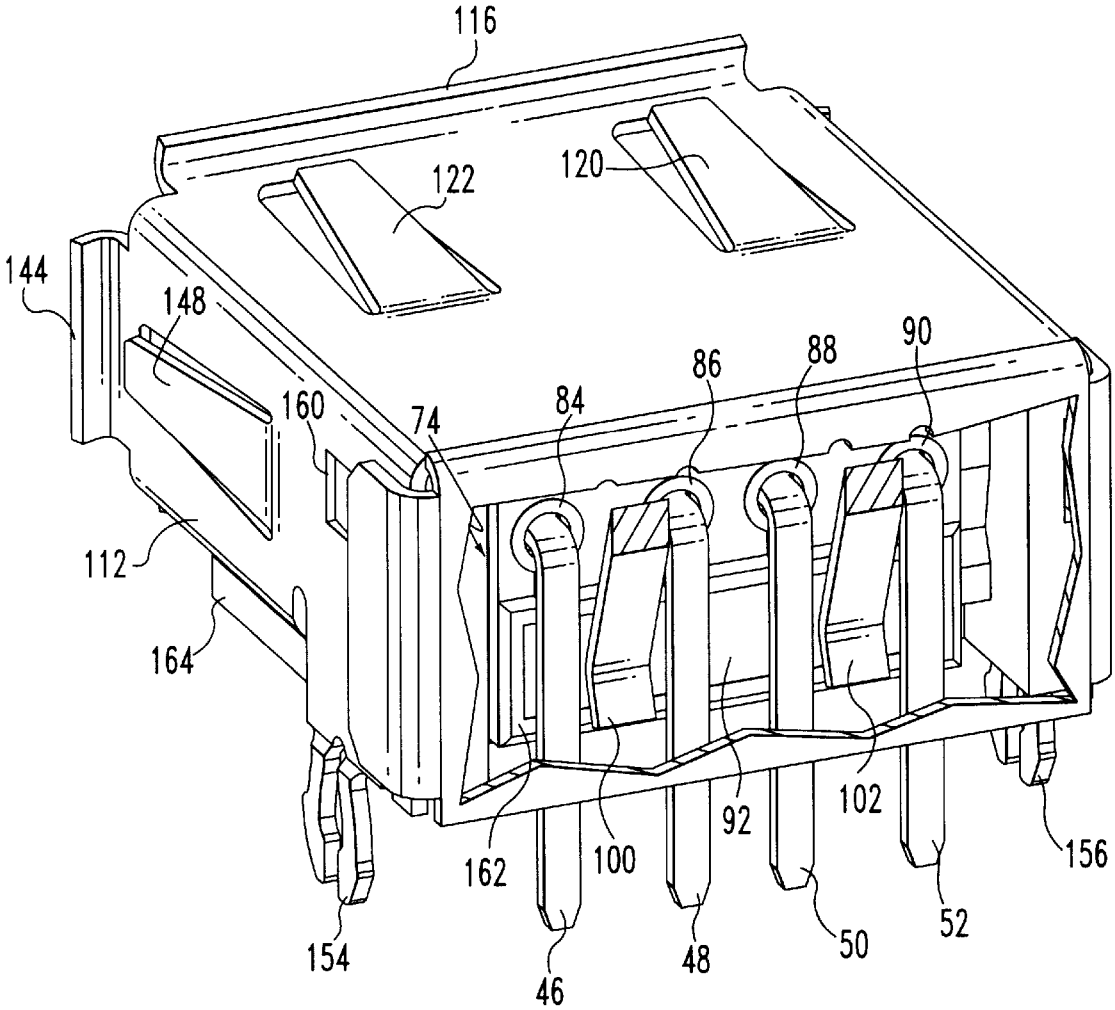
FIG. 7 is a cut away rear perspective view similar to FIG. 6.
Figure 8:
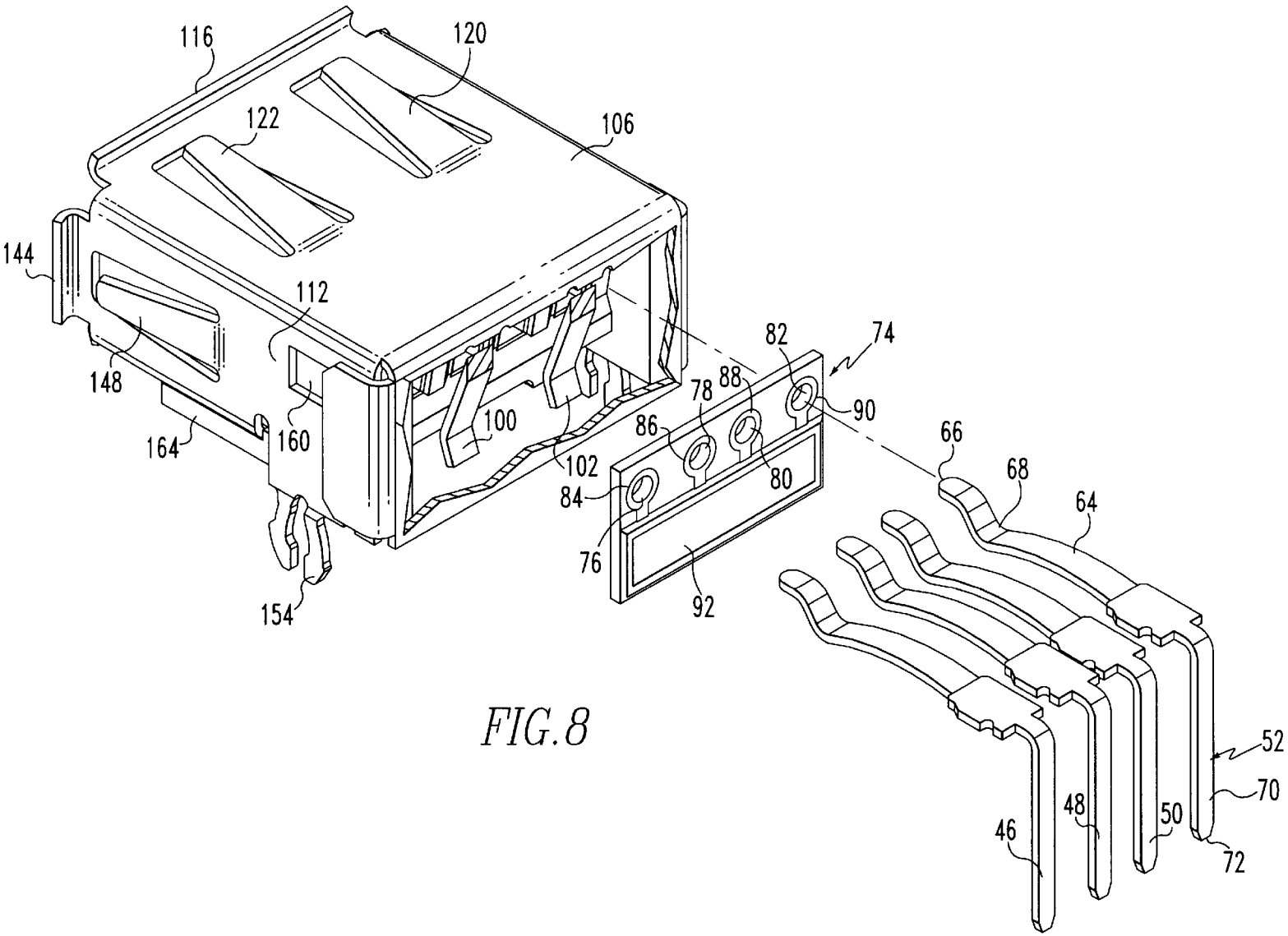
FIG. 8 is a cut away exploded rear perspective view similar to FIG. 7.
Figure 9:
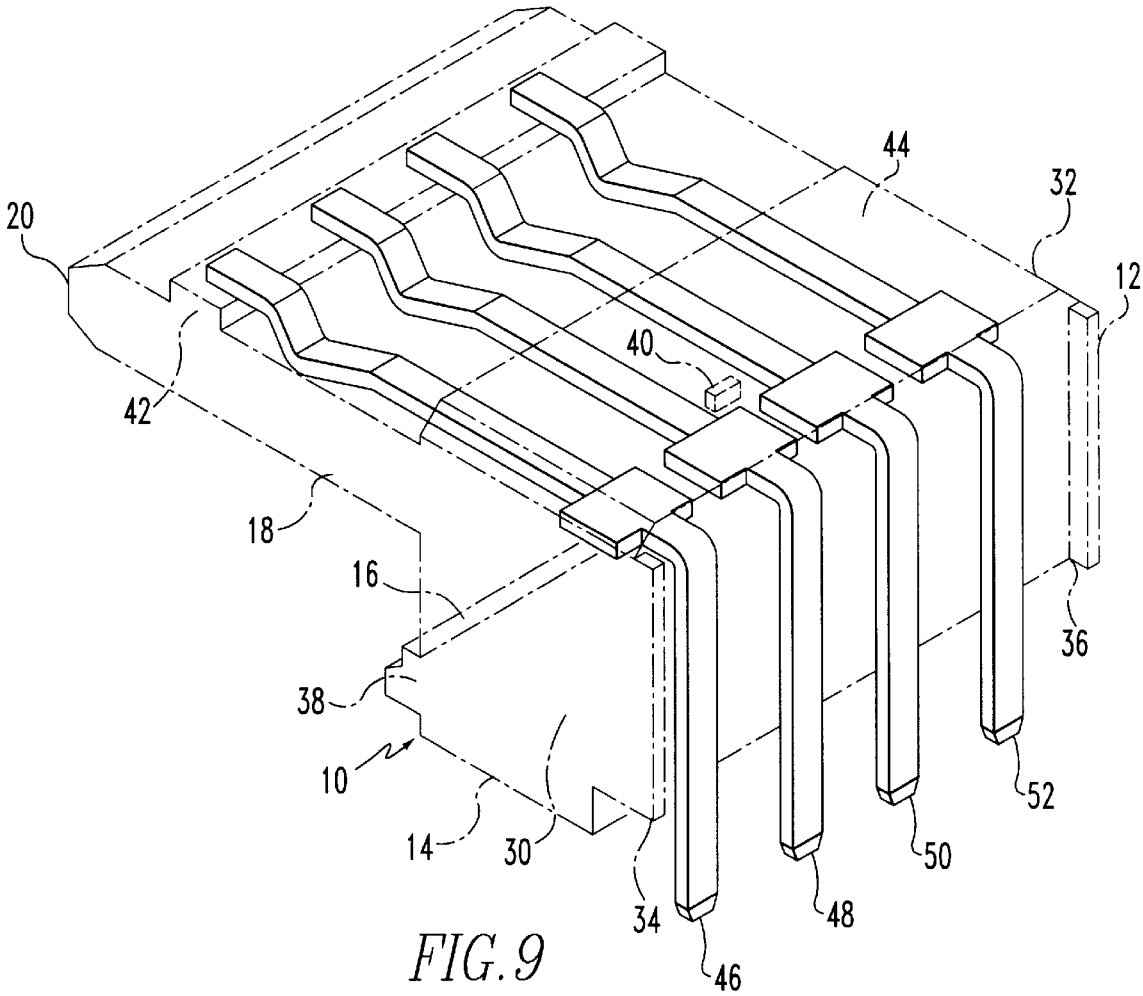
FIG. 9 is a perspective view of the insulative element and conductive contacts in the receptacle shown in FIG. 1.

Referring to the drawings, the receptacle of the present invention includes an insulative member shown generally at numeral 10. As is conventional, this insulative member includes a first vertical section 12 which extends upwardly from a base 14 to an upper side 16. The insulative member then extends horizontally in a second horizontal section 18 to a terminal front edge 20. This second horizontal section 18 includes longitudinal contact receiving slots 22, 24, 26, and 28. The insulative members also have lateral sides 30 and 32 which extend rearwardly, respectively, in rearward lateral ridges 34 and 36. On the forward side of the vertical first section there is a conductive shield retaining lip 38 which has a central clasp receiving aperture 40. Adjacent the terminal front edge of the horizontal second section 18, there is a front contact retaining lip 42. At the opposite end of the horizontal second section of the insulated member there is a rear contact retaining structure 44. It will be understood, however, that all these contacts may be signal contacts and that any one of these contacts may be either a power signal or ground contact depending on system configuration. As is also conventional, signal contacts 46 and 48 and 50 are inserted in the contact receiving grooves 22, 24 and 26 and ground contact 52 is inserted in contact receiving groove 28. Referring particularly to FIG. 5, the signal contacts include a first horizontal section 54 which has a forward terminal end 56 that is engaged by the front contact retaining lip 42. This front section also includes a convex bend 58 which extends beneath the contact receiving slot. The signal contact 50 also includes a second vertical section 60 which extends downwardly parallel to the first vertical section of the insulative member to a PWB engagement end 62. The ground 52 (FIG. 8) also includes a first section 64 which is engaged at forward terminal end 66 by the front contact retaining lip 42 as well as a convex bend 68. The ground contacts also have a second vertical section 70 which extend downwardly in parallel relation to the first vertical section of the insulative member to a terminal PWB engagement end 72.

The capacitive filter element is shown generally at numeral 74. This filter element has transverse apertures 76, 78, 80 and 82. These apertures are surrounded respectively by peripheral conductive members 84, 86, 88 and 90. There is also a conductive ground plane electrode 92 and a signal electrode 94. A dielectric 96 is interposed between these electrodes to form a capacitor. A rear shield 98 is superimposed over the filter 74. Resilient ground springs 100 and 102 extend inwardly from the rear shield to bear against the conductive plane 92 on the filter 74 to help retain the filter in place.

Figure 11:
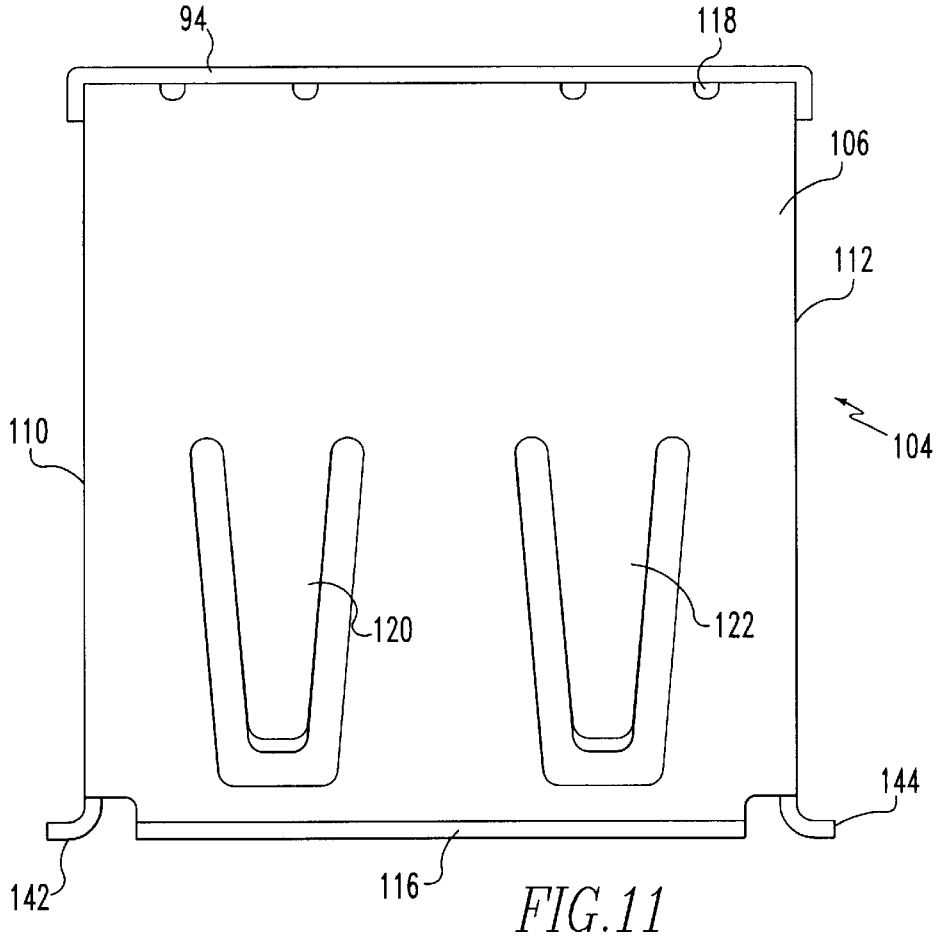
FIG. 11 is a top plan view of the shield element shown in FIG. 10.
Figure 10:
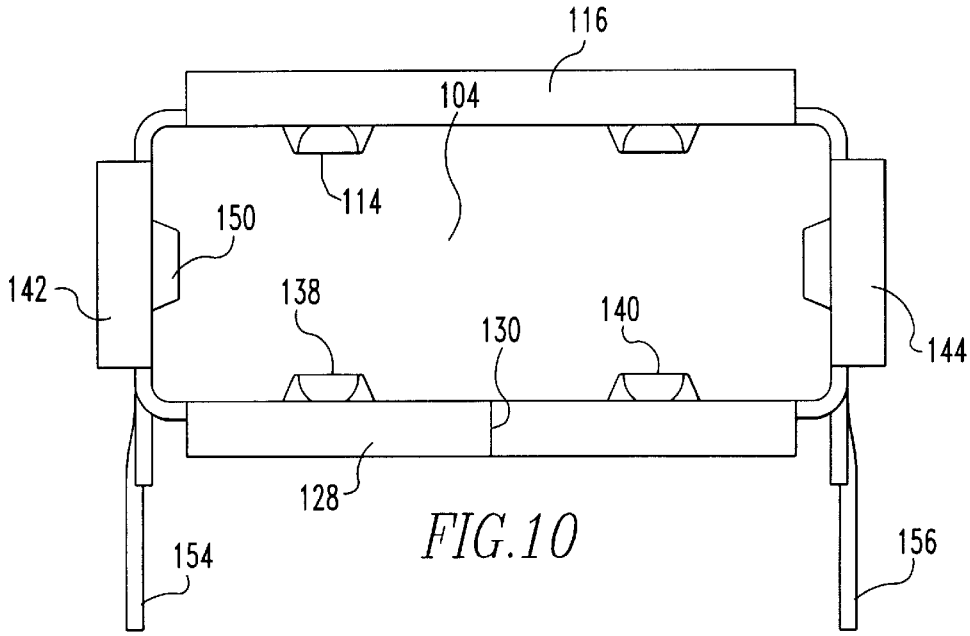
FIG. 10 is a front elevational view of the shield element of the receptacle shown in FIG. 1.
Figure 12:
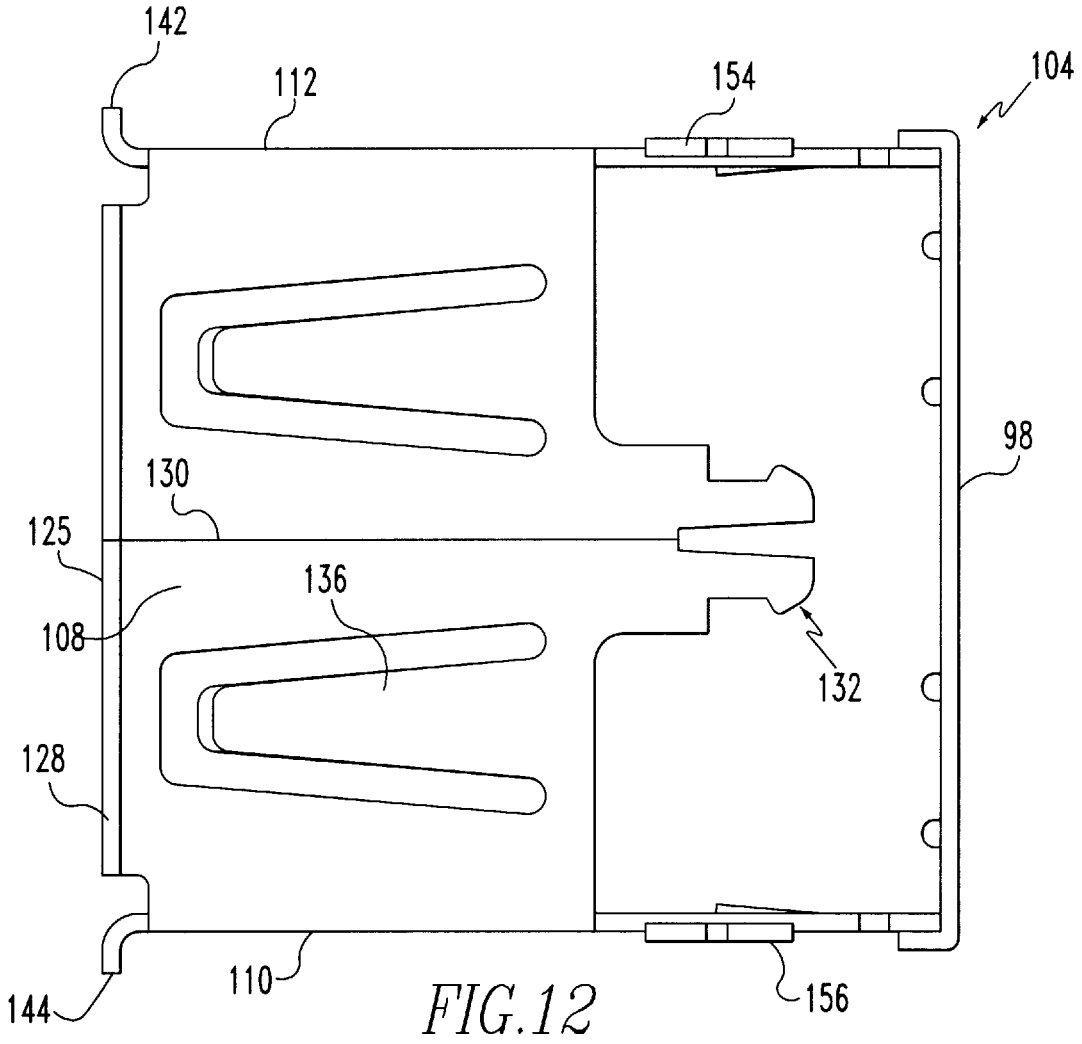
FIG. 12 is a bottom plan view of the shield element shown in FIG. 10.

Referring particularly to FIGS. 10–12, the conductive shield is shown in greater detail generally at numeral 104.

This shield includes a top wall 106, a bottom wall 108 and opposed lateral walls 110 and 112. The rear shield 98 will preferably be an integral part of the rest of the shield and will be bent downwardly from the top wall 106. Between the insulative member and the bottom wall there is a plug receiving space 114. The top wall includes a front flange 116, a number of rear aperture as at aperture 118 and longitudinal springs 120 and 122 which have respectively convex bends 124 and 126 that bear against the second section of the insulative member. The bottom wall includes a front flange 128 and is divided by a medial split 130 and has a rear clasp 132 which is inserted in the central clasp receiving gap 44 in the insulative member. The bottom wall also includes longitudinal springs 134 and 136 which have respectively convex bends 138 and 140 which bear against a plug (not shown) which would be inserted in the plug receiving cavity 114. The lateral walls 110 and 112 include, respectively, front flanges 142 and 144. They also include longitudinal springs 146 and 148 which have, respectively, convex bends 150 and 152 which bear against the lateral sides of the plug upon inserting as will be explained further below. The conductive shield is also equipped with hold downs 154 and 156. The lateral walls 110 and 112 of the shield also respectively have aperture 158 and 160. A non-conductive glazing 162 surrounds the ground plane electrode 92. The entire receptacle is spaced by the PWB by a stand off 164.

It will be appreciated that there has been described a receptacle which is adapted to be mounted on a PWB and which provides an integral filtering means.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. In a universal serial bus receptacle electrical connector for a printed wiring board comprising an insulative member, electrical contacts connected to the insulative member, and a conductive shield on the insulative member, wherein the improvement comprises:

a capacitive filter element connected between at least one of the contacts and the conductive shield, wherein the capacitive filter element comprises multiple conductive members, a common ground plane electrode, and a dielectric member, wherein the conductive members are connected to the common ground plane electrode by the dielectric member, and wherein the common ground plane electrode is connected to the conductive shield.

2. A connector as in claim 1 wherein each of the conductive members comprise an aperture, and wherein the contacts extend through respective ones of the apertures.

3. A connector as in claim 1 wherein the common ground plane electrode is located on a rear side of the capacitive filter element.

4. A connector as in claim 1 wherein the capacitive filter element further comprises a support member, the support member having a general planar shape with apertures therethrough and having the conductive members mounted directly to the support member, and wherein the contacts extend through the apertures in the support member.

5. A connector as in claim 4 wherein the conductive shield comprises springs which bear against the ground plane electrode to help retain the filter in place.

6. A connector as in claim 5 wherein the springs extend inward from a rearward end of the conductive shield.

7. A printed wiring board receptacle electrical connector comprising:

an insulative member;

electrical contacts mounted on the insulative member; and a capacitive filter element electrically connected to at least one of the contacts, the capacitive filter element comprising a signal electrode, a ground plane electrode, and a dielectric member directly between the signal electrode and the ground plane electrode, wherein the contacts extend into a plug receiving area of the connector and the at least one contact is directly contacted by the signal electrode for connecting the at least one contact to a ground through the capacitive filter element.

8. A connector as in claim 7 wherein the contacts each comprise a deflectable spring arm extending into the plug receiving area of the connector, and a printed wiring board engagement end.

9. A connector as in claim 8 wherein the contacts each comprise a horizontal section comprising the deflectable spring arm and a vertical section comprising the engagement end.

10. A connector as in claim 9 wherein the capacitive filter element is located generally parallel to the vertical sections at a rear end of the connector.

11. A connector as in claim 10 wherein the capacitive filter element further comprises a planar support board having the signal electrode attached to a rear side of the support board, the support board having apertures therethrough with portions of the horizontal sections of the contacts extending through the apertures.

12. A connector as in claim 7 wherein the capacitive filter element further comprises a rigid support member having the signal electrode directly thereon.

13. A connector as in claim 12 wherein the signal electrode is located on a rear side of the rigid support member.

14. A connector as in claim 12 wherein the capacitive filter element comprises a plurality of the signal electrodes on the support member connected by the dielectric member to the same ground plane electrode.

15. A connector as in claim 7 wherein the ground plane electrode is located on a rear side of the capacitive filter element.

16. A connector as in claim 15 wherein the ground plane electrode extends across a majority of a width of the capacitive filter element.

17. A connector as in claim 7 further comprising a conductive shield surrounding the contacts and the insulative member, the shield comprising a deflectable spring which directly contacts the ground plane electrode.

18. A connector as in claim 17 wherein the spring is integrally formed with the shield as a one-piece member.

19. A printed wiring board receptacle electrical connector comprising:

an insulative member;

electrical contacts mounted on the insulative member;

a conductive shield mounted around the insulative member; and a capacitive filter element having conductive members electrically connecting at least one of the contacts to the conductive shield, wherein the capacitive filter element is retained by resilient ground springs of the conductive shield bearing against a ground plane electrode of the capacitive filter element to bias the capacitive filter element against the insulative member.

* * * * *